United States Patent [19]

Spinner et al.

[11] Patent Number: 4,494,094

[45] Date of Patent: Jan. 15, 1985

[54] HIGH FREQUENCY WAVEGUIDE

[75] Inventors: Georg Spinner, Feldkirchen-Westerham; Franz X. Pitschi, Rottach-Egern, both of Fed. Rep. of Germany

[73] Assignee: Spinner GmbH Elektrotechnishe Fabrik, Fed. Rep. of Germany

[21] Appl. No.: 438,940

[22] Filed: Nov. 3, 1982

[30] Foreign Application Priority Data

Nov. 4, 1981 [DE] Fed. Rep. of Germany ..... 3143773

[51] Int. Cl.[3] ..... H01P 3/12

[52] U.S. Cl. ..... 333/239; 29/600; 52/731; 138/171

[58] Field of Search ..... 333/239, 248; 138/156, 138/157, 170, 171, 177; 29/600; 52/731

[56] References Cited

U.S. PATENT DOCUMENTS 1,928,009 9/1933 Dornier ..... 138/177
3,195,079 7/1965 Burton et al. ..... 333/239
3,952,267 4/1976 Dischert ..... 333/248 X

FOREIGN PATENT DOCUMENTS 1120530 12/1961 Fed. Rep. of Germany .
3143773 3/1984 Fed. Rep. of Germany .

*Primary Examiner*—Paul Gensler
*Attorney, Agent, or Firm*—Ostrolenk, Faber, Gerb & Soffen

[57] ABSTRACT

For a rectangular waveguide the wall thickness of the narrow sides b of the rectangle is smaller than the wall thickness of the broad sides a of the rectangle with the ratio of the wall thicknesses being so chosen that approximately the same resistance to deformation is obtained in both directions. For waveguides which consist of welded plates the broad sheet metal plates 10 are cut to the nominal inner dimension and the sheet metal plates which form the narrow sides and have a lower wall thickness abut laterally against the two plates belonging to the a side.

3 Claims, 2 Drawing Figures

FIG. 1
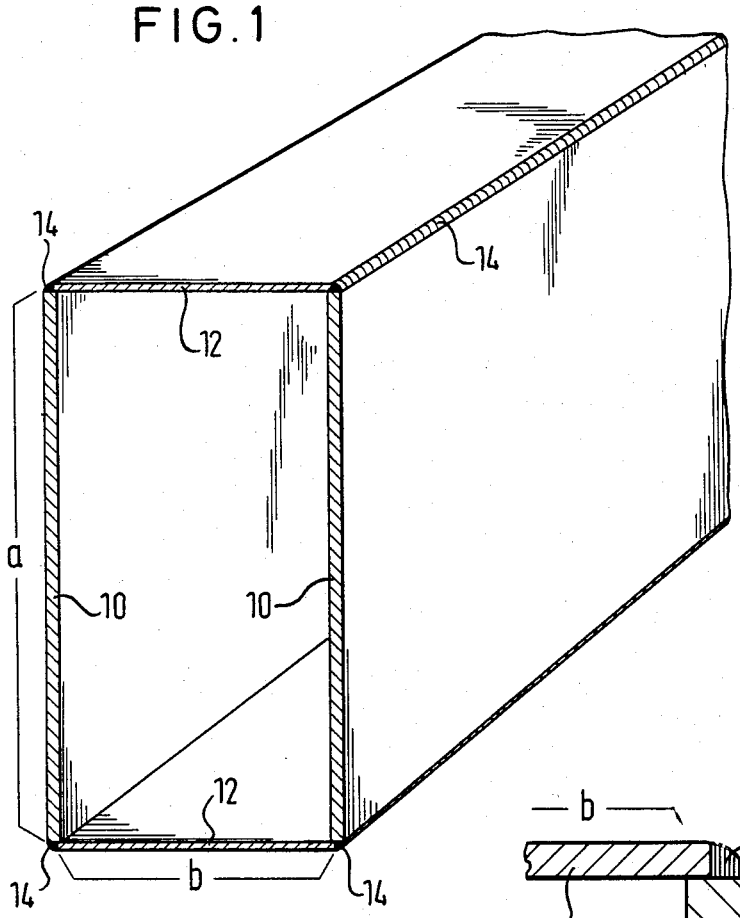
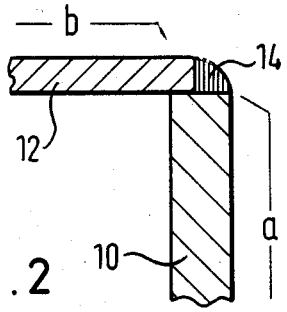
FIG. 2

HIGH FREQUENCY WAVEGUIDE

The invention relates to a high frequency waveguide in the form of a rectangular tube. Such waveguides were previously provided with equal wall thicknesses for the narrow and broad sides irrespective of whether they were extruded, drawn or, for larger dimensions, manufactured from welded plates of sheet metal.

Rectangular waveguides, in particular those of large dimensions for low frequencies are of large weight and require considerable quantities of material.

The principal object underlying the invention is thus to reduce the material expense and the weight of such rectangular waveguides while retaining the favourable transmission characteristics.

The named object is satisfied by the features set forth in the characterizing part of patent claim 1. Depending on the side ratio of the waveguide the wall thickness of the plates which form the narrow sides can be reduced by one half and even more without the form stiffness suffering. For waveguides which consist of plates of sheet metal there is also the advantage that the mechanical distortion on welding the sheet metal is less.

Further expedient embodiments of the invention are given in the sub-claims.

An embodiment of the invention will now be described in the following with reference to the drawing which shows:

FIG. 1 a perspective view of a section of a high frequency rectangular waveguide, and FIG. 2 to a larger scale, a detail of a portion of FIG. 1.

The rectangular waveguide of FIG. 1 consists of sheet metal plates 10 which form the broad sides a of the rectangular waveguide and sheet metal plates 12 which form the narrow sides b. The wall thickness of the plates 10 is larger than the wall thickness of the plates 12. In the illustrated embodiment the wall thickness of the narrow plates 12 is approximately half as large as the wall thickness of the broad plates 10. As can be seen from FIG. 2, the broad plates of sheet metal 10 are manufactured to the internal dimension of the broad sides a of the rectangle and the narrow thin plates 12 lie approximately half-way over the broad sides thus resulting in a right-angled, isosceles triangle for the weld groove in which the weld bead 14 is deposited.

Depending on the side ratio of the waveguide, the wall thickness is so dimensioned that approximately the same stiffness is achieved in the two directions and a stiffness against elastic deformation which is almost the same as that of a waveguide which is manufactured of sheet metal of equal thickness.

When the side ratio of the waveguide amounts to 1:2, then the plate thickness of the narrow sheet metal plates 12 is approximately 50 to 70% of the plate thickness of the broad sheet metal plates 10. When the side ratio is even larger than 1:2, the wall thickness of the narrow sides can be reduced even further.

In the illustrated embodiment, the waveguide is manufactured from welded sheet metal. This embodiment can be considered for large waveguides for frequencies below 1,000 MHz. which can no longer be economically extruded or drawn. The invention is however not restricted to welded waveguides and advantages with respect to a saving of material also result with extruded or drawn rectangular waveguides when the wall thickness of the narrow sides of the right angle is made correspondingly smaller than that of the broad sides of the rectangle.

We claim:

1. A high frequency waveguide comprising a tube of rectangular cross-section having a first pair of plates parallel to each other and forming a first pair of opposite walls; a second pair of plates parallel to each other and forming a second pair of opposite walls of said rectangular tube;

the plates of said first pair of opposite walls being of the same thickness with respect to each other and the plates of said second pair of opposite walls being of the same thickness with respect to each other;

the second pair of opposite walls being transversely smaller in the cross-sectional dimension of said rectangular tube than the first pair of opposite walls;

the plates forming said second pair of opposite walls being of the order of half the thickness of the plates forming the first pair of opposite walls.

2. The high frequency waveguide of claim 1, wherein said plates of said second pair of smaller opposite walls are welded by means of a "V" seam on the edges of said plates of said first pair of opposite walls.

3. The high frequency waveguide of claim 2, wherein the plates of the second pair of walls extend along the side edges of the plates of such first pair of walls up to half the wall thickness of the plates of such first pair of walls forming the base for said "V" seam.

* * * * *